US006517642B2

(12) United States Patent
Horie et al.

(10) Patent No.: US 6,517,642 B2
(45) Date of Patent: Feb. 11, 2003

(54) METHOD AND APPARATUS OF PRODUCING THIN FILM OF METAL OR METAL COMPOUND

(75) Inventors: Kuniaki Horie, Tokyo (JP); Akira Fukunaga, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/726,552

(22) Filed: Dec. 1, 2000

(65) Prior Publication Data

US 2001/0010837 A1 Aug. 2, 2001

(30) Foreign Application Priority Data

Dec. 1, 1999 (JP) ..... 11-341962

(51) Int. Cl.[7] ..... B22F 7/04

(52) U.S. Cl. ..... 148/220; 148/235; 148/513; 148/283; 148/284; 419/9

(58) Field of Search ..... 148/207, 217, 148/220, 238, 513, 283, 284; 75/364, 365, 370; 419/9

(56) References Cited

U.S. PATENT DOCUMENTS 4,395,440 A * 7/1983 Abe et al. ..... 427/180
4,731,295 A * 3/1988 Yamamoto et al. ..... 428/472
4,800,064 A * 1/1989 Kemp et al. ..... 75/365
5,966,580 A * 10/1999 Watanabe et al. ..... 419/9
6,168,694 B1 * 1/2001 Huang et al. ..... 148/238

OTHER PUBLICATIONS

ASM Handbook, vol. 7, Powder Metalllurgy, ASM International, 1984, pp. 36–37.*

* cited by examiner

*Primary Examiner*—George Wyszomierski
(74) *Attorney, Agent, or Firm*—Browdy and Neimark, P.L.L.C.

(57) ABSTRACT

A thin film of metal or metal compound is produced by preparing an ultrafine particle dispersion liquid by dispersing ultrafine particles at least partly made of metal into a given organic solvent, applying the ultrafine particle dispersion liquid to a substrate, drying the ultrafine particle dispersion liquid to leave metal or metal compound particles on the substrate, heating the metal or metal compound particles to join the metal or metal compound particles, and annealing the metal or metal compound particles into a thin film.

18 Claims, 4 Drawing Sheets

METHOD AND APPARATUS OF PRODUCING THIN FILM OF METAL OR METAL COMPOUND

BACKGROUND OF THE INVENTION

1. Field of the Invention

The present invention relates to a method and an apparatus of producing a thin film of metal oxide or the like on a surface of a substrate.

2. Description of the Related Art

Thin films of metal oxides are generally used as oxide dielectric and insulating films of $SiO_2$ and $Ta_2O_5$, high dielectric and ferroelectric films having a Perovskite structure represented by $ABO_3$, in particular, of $BaTiO_3$, $Ba(Ti,Hf,Zr)O_3$, $SrTiO_3$, $(Ba,Sr)TiO_3$, $(Ba,Sr,Ca)TiO_3$, $PbTiO_3$, $PbZrO_3$, $Pb(Nb,Ti)O_3$, $Pb(Zr,Ti)O_3$, PLZT, $YMnO_3$, and $(La,Sr)MnO_3$, ferroelectric films having other structures, of $SrBi_2Ta_2O$, $SrBi_2(Ta,Nb)_2O_9$, $Sr_2(Ta,Nb)O_7$, $(Sr,Ba)Nb_2O_6$, $SrTa_2O_6$, $Bi_4Ti_3O_{12}$, and $Bi_2SiO_5$, electrode films of $RuO_2$, $RuO_4$, $SrRuO_3$, and $IrO_2$, and buffer films of $Y_2O_3$, $CeO_2$, $ZrO_2$, and $(Ce,Zr)O_2$ for memory materials of MFIS-FET, MFMIS-FET structures and films exemplified by ferroelectric films.

Thin films of metal sulfides are used as thin films for use in light-emitting elements. For example, thin films of metal sulfides are used as inorganic EL films including thin films for blue light-emitting elements, of $CaGa_2S_4$+Ce, ZnS+Tm, SrS+Ce+blue filter, and SrS+Cu, thin films for green light-emitting elements, of ZnS+Tb, CaS+Ce, ZnS+Mn+green filter, and $SrGa_2S_4$+Eu, thin films for red light-emitting elements, of SrS+Sm, CaS+Eu, and ZnS+Mn+red filter, and protective films for light-emitting films, of ZnS.

Thin films of metal nitrides are generally used as nitride dielectric and insulating films of SiN and SiON, electrode films of TaN and TiN, and barrier films of TaN, TaSiN, TiN, TiSiN, WN, WSiN, and (Ti,Al)N.

Heretofore, thin films of metals such as metal oxides have generally been manufactured by an evaporation process and a CVD process. According to the evaporation process, a desired material is evaporated to deposit a film on a substrate in a vacuum whose pressure is $10^{-2}$ Pa or lower. According to the CVD process, a thin film of a material produced by thermal decomposition or chemical reaction is precipitated on a substrate.

However, the production of thin films of metals according to the evaporation process or the CVD process requires an expensive, large-scale evacuating apparatus, which needs a large expenditure of initial expenses. In addition, the evaporation process or the CVD process requires a relatively long period of time to grow the desired film, and causes the substrate to be held at a high temperature during the film growth. While it has been attempted to produce thin films of metals according to a sol-gel process, it has proven difficult to achieve a sufficient bonding strength between the substrate and the thin film.

SUMMARY OF THE INVENTION

It is therefore an object of the present invention to provide a method and an apparatus of inexpensively and quickly producing a thin film of metal that is bonded to a substrate with a sufficient bonding strength, without the use of an expensive, large-scale evacuating apparatus.

According to a first aspect of the present invention, there is provided a method of producing a thin film of metal or metal compound, comprising: preparing an ultrafine particle dispersion liquid containing ultrafine particles at least partly made of metal, said ultrafine particles being dispersed into a given organic solvent; applying said ultrafine particle dispersion liquid to a surface of a substrate; drying said ultrafine particle dispersion liquid to leave metal or metal compound particles on said substrate; and heating said metal or metal compound particles to join said metal or metal compound particles together.

According to a second aspect of the present invention, there is provided a method of producing a thin film of metal or metal compound, comprising: preparing an ultrafine particle dispersion liquid containing ultrafine particles at least partly made of metal, said ultrafine particles being dispersed into a given organic solvent; applying said ultrafine particle dispersion liquid to a surface of a substrate; heating said ultrafine particle dispersion liquid to leave metal or metal compound particles on said substrate and join said metal or metal compound particles together; and annealing said joined metal or metal compound particles.

According to a third aspect of the present invention, there is provided a method of producing a thin film of metal or metal compound, comprising: preparing an ultrafine particle dispersion liquid containing ultrafine particles at least partly made of metal, said ultrafine particles being dispersed into a given organic solvent; applying said ultrafine particle dispersion liquid to a surface of a substrate; drying said ultrafine particle dispersion liquid to leave metal or metal compound particles on said substrate; heating said metal or metal compound particles to join said metal or metal compound particles together; and annealing said joined metal or metal compound particles.

According to a forth aspect of the present invention, there is provided an apparatus of producing a thin film of metal or metal compound, comprising: a dispersion liquid supply device for applying ultrafine particle dispersion liquid containing ultrafine particles at least partly made of metal, said ultrafine particles being dispersed into a given organic solvent to a surface of a substrate; a drying mechanism for drying said ultrafine particle dispersion liquid to leave metal or metal compound particles on said substrate; and a heating device for heating said metal or metal compound to join said metal or metal compound particles together.

With the above methods and an apparatus, ultrafine particles uniformly dispersed in a organic solvent and at least partly made of metal are uniformly coated on a surface of a substrate, and all organic materials are heated and decomposed to join metal or metal compound particles, producing a thin film of metal bonded to the substrate with a sufficiently large bonding strength. The thin film may then be annealed into a crystalline state.

The metal or metal compound particles may be heated or annealed in an oxidizing gas atmosphere to produce a thin film of metal oxide. The thin film of metal oxide may be made of $SiO_2$, $Ta_2O_5$, $BaTiO_3$, $Ba(Ti,Hf,Zr)O_3$, $SrTiO_3$, $(Ba,Sr)TiO_3$, $(Ba,Sr,Ca)TiO_3$, $PbTiO_3$, $PbZrO_3$, $Pb(Nb,Ti)O_3$, $Pb(Zr,Ti)O_3$, PLZT, $YMnO_3$, $(La,Sr)MnO_3$, $SrBi_2Ta_2O_9$, $SrBi_2(Ta,Nb)_2O_9$, $Sr_2(Ta,Nb)O_7$, $(Sr,Ba)Nb_2O_6$, $SrTa_2O_6$, $Bi_4Ti_3O_{12}$, $Bi_2SiO_5$, $RuO_2$, $RuO_4$, $SrRuO_3$, $IrO_2$, MFIS-FET,$Y_2O_3$, $CeO_2$, $ZrO_2$, or $(Ce,Zr)O_2$.

The metal or metal compound particles may be heated or annealed in a hydrogen sulfide atmosphere to produce a thin film of metal sulfide. The thin film of metal sulfide may be made of $CaGa_2S_4$+Ce, ZnS+Tm, SrS+Ce, SrS+Cu, ZnS+Tb, CaS+Ce, ZnS+Mn, $SrGa_2S_4$+Eu, SrS+Sm, CaS+Eu, ZnS+Mn, and ZnS.

The metal or metal compound particles may be heated or annealed in a nitriding gas atmosphere to produce a thin film of metal nitride. The thin film of metal nitride may be made of SiN, SiON, TaN, TaSiN, TiN, TiSiN, AlN, WN, and ZrN.

The metal may comprise at least one metal selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

In a preferred aspect of the invention, an apparatus further comprising a supplementary drying device for drying the ultrafine particle dispersion liquid which has not evaporated by said drying mechanism. Therefore, an organic solvent is completely dried by the supplementary drying device to prevent the formation of voids.

The above and other objects, features, and advantages of the present invention will become apparent from the following description of preferred embodiments of the present invention which are given by way of example.

DETAILED DESCRIPTION OF THE PREFERRED EMBODIMENTS

Figure 1:
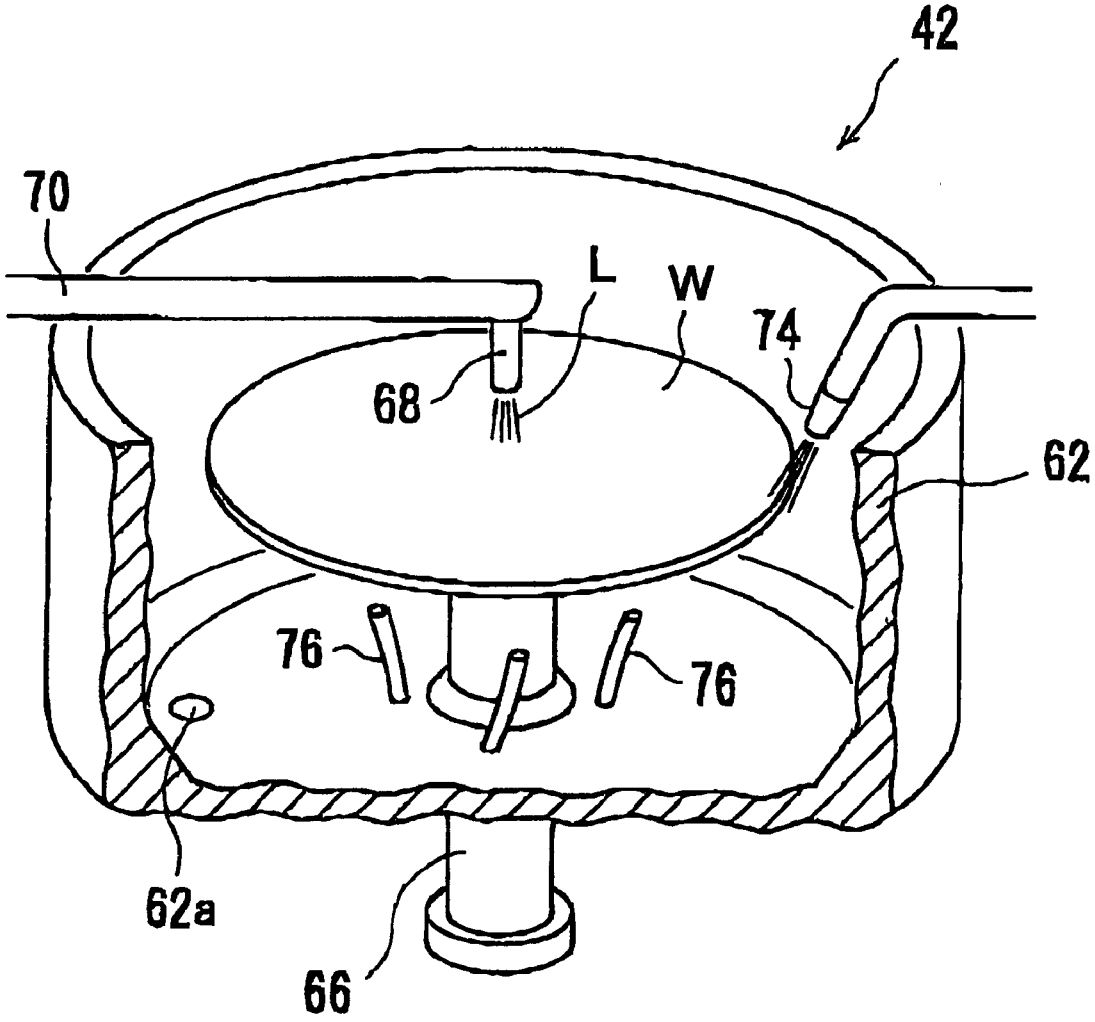
FIG. 1 is a perspective view of a dispersion liquid supply device.

A method of producing a thin film of metal or metal compound according to the present invention will be described below with respect to its successive steps.

1ST STEP:

First, an ultrafine particle dispersion liquid is prepared by dispersing ultrafine particles at least partly made of metal into a given organic solvent.

The ultrafine particles are composite ultrafine articles each comprising a metal core (ultrafine metal) article covered with organic materials. The ultrafine particles may be produced, for example, by making a fatty acid salt (metal organic compound) through a reaction between a metal salt and a fatty acid, thermally treating the fatty acid salt at a temperature that is equal to or higher than a decomposition starting temperature and lower than a full decomposition temperature of the fatty acid salt, and refining the thermally treated fatty acid salt. When a nitrate (metal: M) is used as the metal salt, the reaction is expressed as follows:

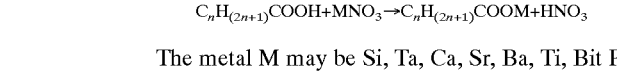

$$C_nH_{(2n+1)}COOH+MNO_3 \rightarrow C_nH_{(2n+1)}COOM+HNO_3$$

The metal M may be Si, Ta, Ca, Sr, Ba, Ti, Bit Pb, Nb, Y, Mn, Al, Hf, Zr, Ce, Ir, Ru, En, Mg, La, Ga, Tm, Cu, Tb, Eu, Sm, or WI which may be selected depending on how the thin film will be used.

Each of the composite ultrafine particles thus produced seem to be comprising a central metal core having a diameter of about 5 nm and covered with organic materials. Therefore, when the composite ultrafine particles are dissolved into an organic solvent such as cyclohexane or the like, they are not aggregated, but uniformly mixed stably together into a transparent soluble state.

Ultrafine particles can also be produced by heating, in an nonaqueous solvent and in the presence of ionic organic materials, a metal salt at a temperature which is equal to or higher than the decomposition and reduction temperature of the metal salt and equal to or lower than the decomposition temperature of the ionic organic material. Ultrafine particles that are produced by other processes may also be used.

The organic solvent may comprise cyclohexane, n-hexane, toluene, kerosine, or the like. The ultrafine particle dispersion liquid which is prepared by dissolving and dispersing ultrafine particles in the organic solvent is substantially transparent because the dispersed ultrafine particles are very small. Various properties , e.g., the viscosity, the volatility, the surface tension (wettability with respect to the substrate), etc. of the organic solvent can freely be adjusted by selecting the type of the organic solvent, the concentration of the ultrafine particles the temperature of the organic solvent, etc. For easy removal of the organic solvent, the organic solvent should preferably be volatilized relatively easily. For example, if the organic solvent comprises alcohol, then it can be volatilized quickly at room temperature. The temperature at which and the time for which the organic solvent is volatilized can freely be set by selecting the organic solvent depending on the process.

An ultrafine particle dispersion liquid may alternatively be prepared as a mixture of ultrafine particles made of a plurality of metal materials. In preparing such an ultrafine particle dispersion liquid, the mixture ratio (composition ratio) of the metal materials may freely be changed, and they may be mixed highly uniformly together microscopically into a mixed ultrafine particle dispersion liquid that is microscopically uniform. The ultrafine particle dispersion liquid that is mixed microscopically uniformly may be produced by either a process of preparing more than two types of ultrafine particles having different types of metal cores, dissolving the ultrafine particles into an organic solvent, passing the liquid between close objects having different speeds or instantaneously displacing the liquid into regions having different speeds thereby imparting an intensive mechanical shearing forces to the liquid, or a process of passing the above liquid between a rotating body and a stationary body spaced closely from the rotating body or instantaneously displacing the liquid from the gap near the rotating body to the region of the stationary body thereby imparting an intensive mechanical shearing forces to the liquid, or a process of instantaneously depressurizing the liquid from a pressurized state via a resistive body thereby imparting a pressure difference to the liquid, or a process of applying high-frequency vibrations such as ultrasonic vibrations to the liquid.

2ND STEP:

Then, the ultrafine particle dispersion liquid is applied to the surface of a substrate. For example, the substrate is uniformly coated with the ultrafine particle dispersion liquid by a spin coating process. The substrate may be coated with the ultrafine particle dispersion liquid to a uniform thickness by adjusting the spinning speed, and properties of the ultrafine particle dispersion liquid which include the viscosity, the surface tension, etc. If the ultrafine particle dispersion liquid is applied to a local area or small spot on a substrate, then the substrate may be coated with the ultrafine particle dispersion liquid by an ink jet process. If the thickness uniformity or coating efficiency is not of prime importance, then the substrate may be coated using a brush with the ultrafine particle dispersion liquid.

If an ultrafine particle dispersion liquid having an increased organic solvent proportion and a reduced ultrafine particle concentration is used, then it may be applied to the surface of the substrate to form a thin film. If an ultrafine particle dispersion liquid having a reduced organic solvent proportion and an increased ultrafine particle concentration is used, then it may be applied to the surface of the substrate to form a thick film in a single coating cycle.

If the ultrafine particle dispersion liquid is applied as a jet stream at a high speed of 10 m/s or higher to the surface of the substrate, or if the ultrafine particle dispersion liquid is vibrated by a vibrator at a high frequency of about 200 kHz, or preferably 1 MHz or higher, then the ultrafine particle dispersion liquid can easily enter recesses defined in the surface of the substrate. If the ultrafine particle dispersion liquid is applied as a jet stream and also vibrated, then the ultrafine particle dispersion liquid can easily enter pores having a diameter of 0.5 $\mu$m or smaller.

If the ultrafine particle dispersion liquid is applied under vacuum, then a gas in the pores can be removed to allow the ultrafine particle dispersion liquid to easily enter the pores, and if the substrate is vibrated, then the metal of the ultrafine particle dispersion liquid can be embedded highly efficiently in the recesses in the surface of the substrate. The substrate may be vibrated in both horizontal and vertical directions. When the substrate is vibrated horizontally, it may be vibrated individually along two perpendicular axes or it may be rotated. The substrate may be vibrated at a frequency of about 200 kHz, or preferably 1 MHz or higher for allowing the ultrafine particle dispersion liquid to easily enter the pores.

3RD STEP:

Then, the ultrafine particle dispersion liquid applied to the substrate is dried to evaporate the organic solvent of the ultrafine particle dispersion liquid, leaving only the ultrafine particles on the substrate. The ultrafine particle dispersion liquid may be dried at normal temperature or with heat.

4TH STEP:

The ultrafine particles left on the substrate by drying the ultrafine particle dispersion liquid are heated to at least a temperature at which the organic materials is released from the metal core or at least a temperature at which the organic materials is decomposed, so that the organic material is released from the metal cores or dissolved away and at the same time the metal or metal compound particles are melted and joined together in a predetermined atmosphere. In this manner, a thin film of metal or metal compound is formed on the surface of the substrate and bonded thereto with a sufficient bonding strength between the substrate and the thin film. If a thin film of metal oxide is to be produced, then the ultrafine particles are heated in an oxidizing gas atmosphere. If a thin film of metal sulfide is to be produced, then the ultrafine particles are heated in a hydrogen sulfide atmosphere. If a thin film of metal nitride is to be produced, then the ultrafine particles are heated in a nitriding gas atmosphere such as of nitrogen or ammonia. The ultrafine particles may be heated by radiation heating such as resistance heating, infrared heating, far-infrared heating, or the like, or by microwave heating, laser beam heating, plasma heating, or the like.

It is known that the melting point of metal particles is lowered as their diameter is smaller. Such an effect starts to appear when the diameter of the metal particles is 20 nm or less, and manifests itself remarkably when the diameter of the metal particles is 10 nm or less. Therefore, the average diameter of the ultrafine metal particles should preferably range from 1 to 20 nm, and more preferably range from 1 to 10 nm. If very small ultrafine particles in a cluster level having an average diameter of 5 nm are used and a suitable fatty acid is selected, then the ultrafine particles can be heated at about 200° C.

5TH STEP:

The melted and joined metal particles are annealed into a crystalline state. If the ultrafine particles were only heated as described above, they might be remain in an amorphous state. Therefore, if a thin film of metal oxide is to be produced, then the melted and joined metal particles are annealed in an oxidizing gas atmosphere. If a thin film of metal sulfide is to be produced, then the melted and joined metal particles are annealed in a hydrogen sulfide atmosphere. If a thin film of metal nitride is to be produced, then the melted and joined metal particles are annealed in a nitriding gas atmosphere. In this manner, the metal is crystallized.

In this fashion, a thin film such as a thin film of metal oxide, a thin film of metal sulfide, or a thin film of metal nitride which has a uniform film thickness and a sufficient bonding strength is produced. Therefore, a thin film of metal or metal compound which is bonded to a substrate with a sufficient bonding strength can be produced inexpensively and quickly without the need for an expensive, large-scale evacuating apparatus.

In the above embodiment, the steps are carried out independently of each other. However, the steps may be carried out simultaneously. For example, when an ultrafine particle dispersion liquid is ejected from ejector nozzles, the ultrafine particle dispersion liquid may be heated to instantaneously vaporize the organic solvent thereof to simultaneously dry the ultrafine particle dispersion liquid and apply the ultrafine particle dispersion liquid to the substrate. At this time, the ultrafine particle dispersion liquid may be heated at a temperature which is equal to the sum of the boiling point of the organic solvent at the same pressure and 10° C. For example, when processed in the atmosphere, the ultrafine particle dispersion liquid is pressurized and ejected through nozzles each of which has a diameter of 0.5 mm or less to allow only the organic solvent to be vaporized with ease. By adjusting the amount of the organic solvent that is vaporized, the amount of the organic solvent in the coated ultrafine particle dispersion liquid can be adjusted, and hence the properties of the ultrafine particle dispersion liquid on the coated surface can be adjusted.

The substrate may be preheated, and the ultrafine particle dispersion liquid from which the organic solvent has been evaporated as described above may further be heated to decomposed and remove the organic solvent and organic materials covering the metal core. Therefor, the metal and the substrate can be brought into direct contact with each other for an increased bonding strength, and the organic solvent and the organic materials can be prevented from remaining in the thin film of metal or metal compound.

The substrate may be preheated, and the ultrafine particle dispersion liquid may be supplied as a mist to coat the substrate. Even if the ultrafine particle dispersion liquid contains the organic solvent, since the mist has a small mass, it is immediately heated upon arrival at the heated substrate, resulting in removal of the organic solvent and the organic materials. When the mist is electrically charged, the mist can effectively be utilized at an increased rate, and the force with which the mist is attached to the substrate and the heating efficiency of the mist are increased for immediate removal of the organic solvent and the organic materials.

The following process is available for causing the ultrafine particle dispersion liquid to well enter the pores of the substrate:

In step (1), at least a small amount of organic solvent is left in the ultrafine particle dispersion liquid coating the substrate, and the ultrafine particle dispersion liquid is held at a temperature that is equal to or slightly higher than the boiling point of the organic solvent.

In step (2), the atmosphere on the surface of the substrate is replaced with the organic solvent vapor. Specifically, the organic solvent vapor is supplied to the surface of the substrate or cause to flow to the surface of the substrate after it is evacuated.

In step (3), the substrate is coated with the ultrafine particle dispersion liquid while the substrate is being cooled.

In step (1), the surface tension of the ultrafine particle dispersion liquid is lowered and becomes more flowable, it can easily flow into the pores of the substrate.

In step (2), an incompressible gas (air) is eliminated from the pores of the substrate.

In step (3), while the organic solvent vapor is being condensed, the ultrafine particle dispersion liquid is led into the pores.

In this manner, the entry of the ultrafine particle dispersion liquid into the pores is accelerated.

If the substrate is cleaned with the organic solvent which is the same as the organic solvent in the ultrafine particle dispersion liquid to keep the pores in the substrate highly wettable, then the adhesion of the ultrafine particle dispersion liquid to the substrate is increased.

If the substrate is coated with ultrafine particle dispersion liquid in one coating cycle to an excessively large thickness, then gas molecules may have a concentration gradient across the depth or gas molecules may not reach deep regions because of the relationship between elements of oxygen, nitrogen, and sulfur and the metal elements. In order to avoid such a problem occurs, the amount of the ultrafine particle dispersion liquid used in one coating cycle may be adjusted, the ultrafine particles or the jointed metal particles may be treated for oxidation, nitridation, or sulfidation, and a plurality of coating cycles may be repeated to complete the film growth. In this manner, the film can be formed with a uniform distribution of gas molecule concentrations across the depth.

Next, an apparatus of this present invention for perform the above method will be described below with reference to FIGS. 1 through 11.

Figure 2:
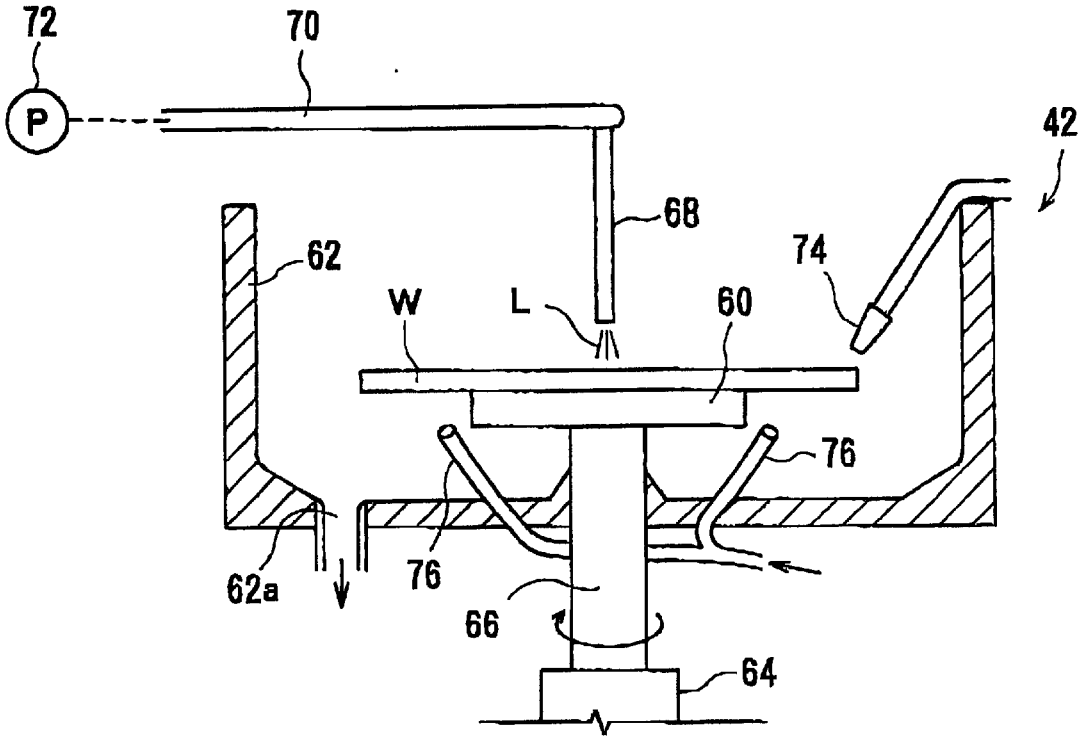
FIG. 2 is a cross-section view of the dispersion liquid supply device.

FIGS. 1 and 2 show the dispersion liquid supply device 42 for supplying an ultrafine particle dispersion liquid L to a surface of a substrate W. The dispersion liquid supply device 42 comprises a substrate holding member 60 for holding a substrate W in such a state that the front surface of the substrate W faces upwardly and rotating the substrate W, and a scattering prevention cup 62 surrounding the substrate W held on the substrate holding member 60. The substrate holding member 60 has a vacuum chuck for attracting and holding the substrate W on the substrate holding member 60. The substrate holding member 60 is connected to an upper end of a shaft 66 coupled to a servomotor 64. Thus, the substrate holding member 60 is rotated by actuating the servomotor 64. The scattering prevention cup 62 is formed of a material resistance to an organic solvent, such as stainless steel.

A dispersion liquid supply nozzle 68 extended downwardly for dropping an ultrafine particle dispersion liquid L is disposed above the center or an eccentric position of the front surface of the substrate W held on the substrate holding member 60. The dispersion liquid supply nozzle 68 is connected to a free end of an arm 70. The arm 70 has a pipe therein for supplying an ultrafine particle dispersion liquid L of a certain amount, for example, a pipe extended from a constant supply device 72 such as a syringe pump. The pipe in the arm 70 communicates the dispersion liquid supply nozzle 68.

Further, a bevel cleaning nozzle 74 extended radially inwardly for supplying a cleaning liquid to a bevel portion of the substrate W is disposed above the peripheral portion of the substrate W held on the substrate holding member 60. The bevel cleaning nozzle 74 is inclined downwardly. A plurality of backside surface cleaning nozzles 76 extended radially outwardly for supplying a gas or a cleaning liquid to the backside surface of the substrate W are disposed below the substrate W held on the substrate holding member 60. The backside surface cleaning nozzles 76 are inclined upwardly. A drain hole 62*a* is formed in the bottom of the scattering prevention cup 62.

The substrate W held on the substrate holding member 60 is rotated at a rotational speed of 300 to 500 rpm, preferably 400 to 500 rpm by actuating the servomotor 64. An ultrafine particle dispersion liquid L of a certain amount is dropped to a central portion of the surface of the substrate W from the dispersion liquid supply nozzle 68. When the surface of the substrate W is covered with the ultrafine particle dispersion liquid L, the dropping of the ultrafine particle dispersion liquid L is stopped, and hence the surface of the substrate W is uniformly coated with the ultrafine particle dispersion liquid L. In this case, a hydrophilic organic solvent such as methanol or acetone, or a cleaning liquid such as ethanol or isopropyl alcohol is simultaneously supplied to the bevel portion of the substrate W from the bevel cleaning nozzle 74, for thereby preventing the outer circumferential surface and the backside surface of the substrate W from being coated with the ultrafine particle dispersion liquid L. Further, a gas such as $N_2$ gas or air, or a cleaning liquid similar to that supplied to the bevel cleaning nozzle 74 is supplied to the backside surface of the substrate W from the backside surface cleaning nozzles 76, for thereby preventing the backside surface of the substrate W from being contaminated.

The substrate W is then rotated via the servomotor 64 in such a state that the dropping of the ultrafine particle dispersion liquid L is stopped. Accordingly, the substrate W is spin-dried (air-dried) to evaporate a solvent contained in the ultrafine particle dispersion liquid L coating the substrate W.

The above process of applying the ultrafine particle dispersion liquid L to the surface of the substrate W and spin-drying the substrate W is repeatedly performed as needed. When the thickness of the ultrafine particle dispersion liquid L coating the substrate W reaches a predetermined level, this process is stopped.

At the end of this process, the substrate W may be rotated at a higher rotational speed to promoting the drying process of the solvent. An extra ultrafine particle dispersion liquid L and the cleaning liquid used for cleaning the bevel portion and the backside surface of the substrate are discharged to the exterior of the dispersion liquid supply device 42 via the drain hole 62*a*.

In this embodiment, the dispersion liquid supply device 42 has a dry mechanism for drying the ultrafine particle liquid. This dry mechanism may be replaced another proper mechanism.

Figure 3:
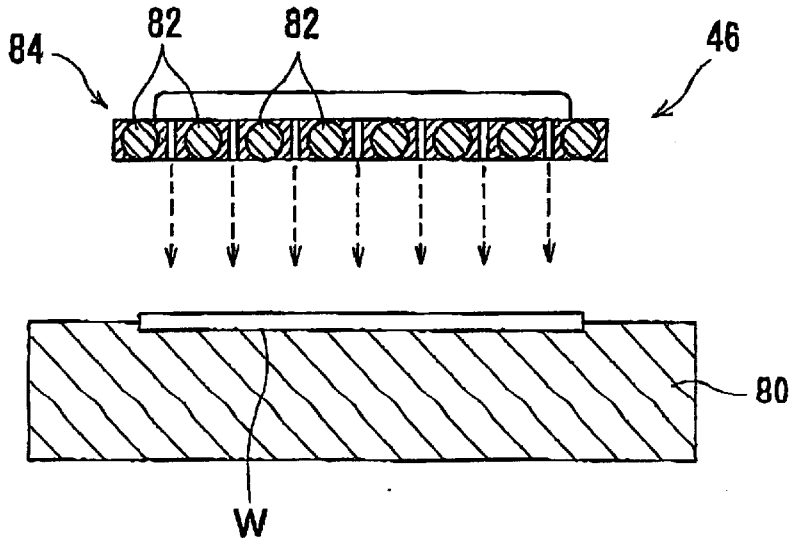
FIG. 3 is a cross-section view of a supplementary drying device.
Figure 4:
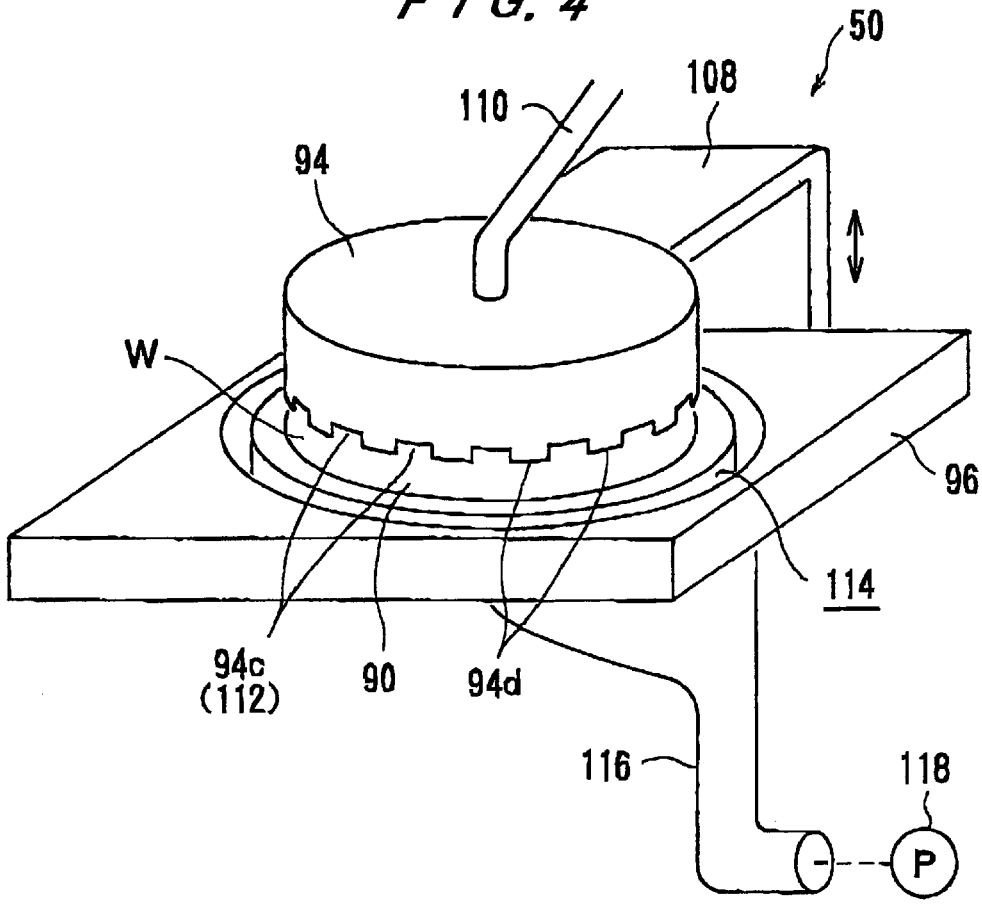
FIG. 4 is a perspective view of a heating device.
Figure 5:
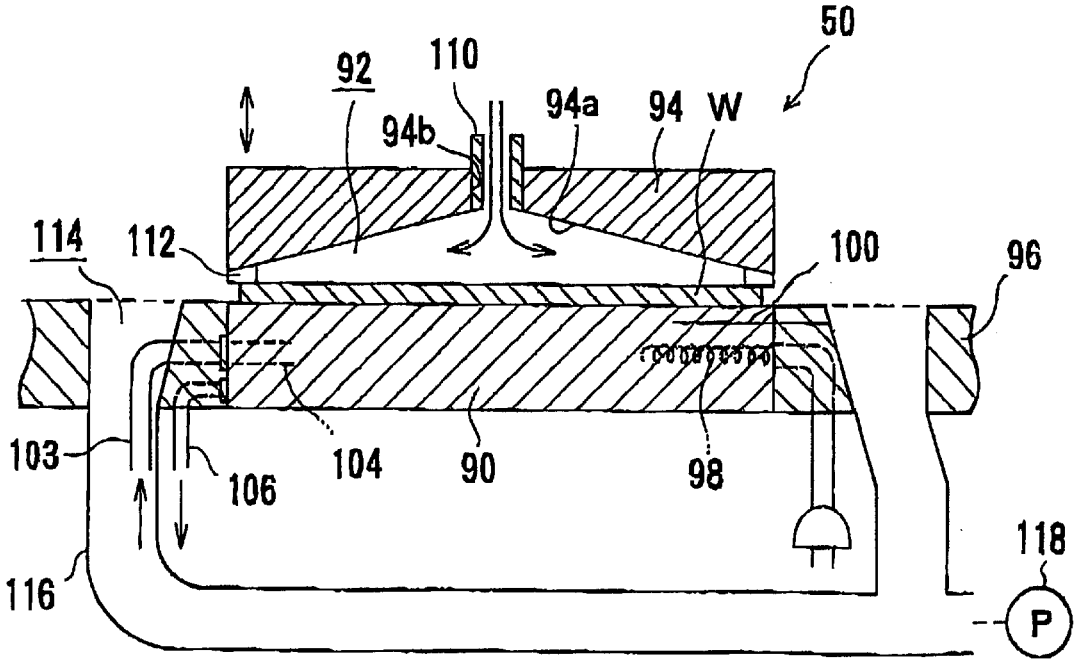
FIG. 5 is a cross-section view of the heating device.
Figure 6:
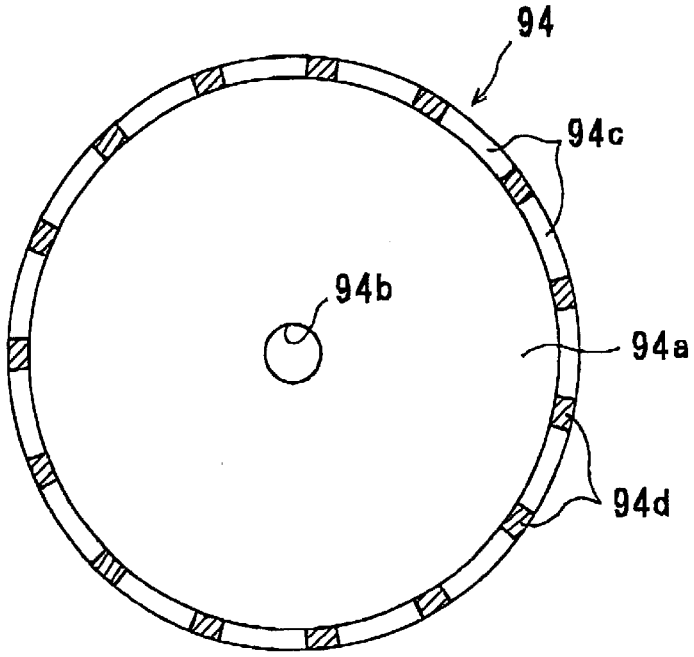
FIG. 6 is a surface-view showing a housing of the heating device.
Figure 7:
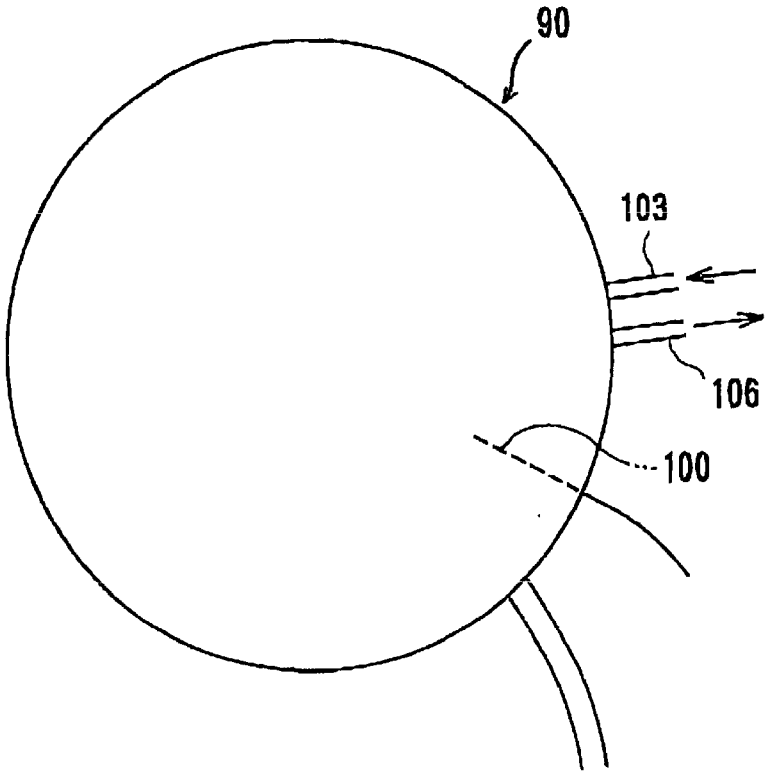
FIG. 7 is a backside-view showing a housing of the heating device.

FIG. 3 shows the supplementary drying device 46. The supplementary drying device 46 comprises a substrate holding member 80 for holding a substrate W in such a state that the front surface of the substrate W faces upwardly, and a heating device 84 disposed above the substrate holding member 80 and having lamp heaters 82, for example.

The supplementary drying device 46 dries a organic solvent that has not be evaporated by the above spin-drying process in the dispersion liquid supply device 42. When a organic solvent is sufficiently dried in the dispersion liquid supply device 42, e.g., in the case of considerably thin coating, the supplementary drying device 46 is not required.

If the heating process is performed in such a state that an organic solvent remains in a composite metal ultrafine particle layer deposited on the surface of the substrate W, then voids are formed on the inside of a film of metal. Therefore, a organic solvent is completely dried by the supplementary drying device 46 to prevent the formation of voids. The supplementary drying device 46 heats the substrate W at a temperature that is lower than the decomposition temperature of the ultrafine particles, preferably about 100° C., to thus prevent contamination caused by decomposition of the ultrafine particles.

FIGS. 4 through 7 show the heating device 50 for heating the composite metal ultrafine particle layer to melt the composite metal ultrafine particles and join them together, and anneal joined metal particles to be into a crystalline state, if necessary. The heating device 50 comprises a heating plate 90 for holding and heating a substrate W in such a state that the front surface of the substrate W faces upwardly, a housing 94 for covering the substrate W held on the heating plate 90 to form a gas chamber 92 between the heating plate 90 and the housing 94, and a frame 96 surrounding the peripheral portion of the heating plate 90.

The heating plate 90 is formed of a material having a high thermal conductivity, such as aluminum or copper, in order to heat the substrate W uniformly and speedily. The heating plate 90 has a disk-like shape and comprises a heater 98 and a temperature sensor 100 for detecting a temperature of the heating plate 90. A flow passage 104 for a cooling medium communicates with an introduction passage 103 for introducing a cooling medium such as coolant gas or air. The flow passage 104 communicates with a discharge passage 106 for discharging a cooling medium.

On the other hand, the housing 94 made of ceramics, for example, is fixed to a free end of an arm 108 which is vertically movable. The housing 94 has a conical recess 94*a*, at its lower surface, for defining a gas chamber 92 between the conical recess 94*a* and the substrate W placed on a heating plate 90 when the housing 94 is moved downwardly. Further, the housing 94 has a gas supply port 94*b*, at its central portion, to which a gas supply pipe 110 is connected. The housing 94 has a lower peripheral portion on which slit portions 94*c* and pressing portions 94*d* are alternately formed. Thus, when the housing 94 is moved downwardly, the pressing portions 94*d* contact the outer peripheral portion of the substrate W placed on the heating plate 90 for thereby holding the substrate W between the heating plate 90 and the pressing portions 94*d*, and defining gas discharge ports 112 by the slit portions 94*c*.

Further, a frame 96 has a substantially annular gas intake port 114. An exhaust duct 116 which communicates with the gas intake port 114 is fixed to the lower surface of the frame 96, and an exhaust blower 118 is connected to the exhaust duct 116.

Thus, the substrate W is placed on the upper surface of the heating plate 90 and held thereon, and the substrate W is heated for five minutes to a temperature of, for example, 300° C. and held at a temperature of 300° C. for five minutes, and then the substrate W is cooled to room temperature in ten minutes, thereby melting composite metal ultrafine particles and joining them together. At this time, inert gas, such as $N_2$, containing a trace amount of oxygen or ozone is introduced into the gas chamber 92 from the gas supply pipe 110, and then inert gas, such as $N_2$, containing no oxygen or ozone is introduced into the gas chamber 92 from the gas supply pipe 110. Since oxygen or ozone serves as catalyst for separating organic materials and metal from each other, decomposition of composite metal ultrafine particles are promoted. Further, lampblack generated when ultrafine particles are decomposed is removed from the surface of the substrate W by $N_2$ gas, for example, and hence the substrate W is prevented from being contaminated by the lampblack which tends to remain on the surface of the substrate, And then, if a thin film of metal oxide is to be produced, then the melted and joined metal particles are annealed in an oxidizing gas atmosphere by introducing an oxidizing gas such as $O_2$, $O_3$ and $N_2O$ to the gas chamber 92. If a thin film of metal sulfide is to be produced, then the melted and joined metal particles are annealed in a hydrogen sulfide atmosphere by introducing a sulfurizing gas such as $N_2S$ to the gas chamber 92. If a thin film of metal nitride is to be produced, then the melted and joined metal particles are annealed in a nitriding gas atmosphere by introducing a nitriding gas such as $N_2$ and $NH_3$ to the gas chamber 92. In this manner, the metal is crystallized.

In this embodiment, a substrate W is transferred to the dispersion liquid supply device 42 and an ultrafine particle dispersion liquid L is supplied to a surface of the substrate W. The substrate W is spin-dried to evaporate an organic solvent contained in the ultrafine particle liquid L coating the substrate W.

Next, the substrate W transferred to the supplementary drying device 46, and an organic solvent that has not be evaporated by the above spin-drying process in the dispersion liquid supply device 42 is dried.

And then, the substrate W transferred to the heating device 50 The composite metal ultrafine particle layer formed on the surface of the substrate is heated to melt the composite metal ultrafine particles and join together. After that, a thin film of metal formed on the surface is annealed to crystallize the thin film of the metal.

According to the present invention, as described above, a surface of a substrate is uniformly coated with ultrafine particles uniformly dispersed in a organic solvent and at least partly made of metal, and all organic materials are heated and decomposed to melt and join metal or metal compound particles, producing a thin film of metal bonded to the substrate with a sufficiently large bonding strength. The thin film may then be annealed into a crystalline state. Therefore, a thin film of metal or metal compound which is bonded to a substrate with a sufficient bonding strength can be produced inexpensively and quickly without the need for an expensive, large-scale evacuating apparatus.

Although certain preferred embodiments of the present invention have been described in detail, it should be understood that various changes and modifications may be made therein without departing from the scope of the appended claims.

What is claimed is:

1. A method of producing a thin film of metal compound, comprising preparing an ultrafine particle dispersion liquid containing ultrafine particles at least partly made of metal, said ultrafine particles being dispersed into a given organic solvent;

applying said ultrafine particles dispersion liquid to a surface of a substrate;

drying said ultrafine particle dispersion liquid to leave metal or metal compound particles on said substrate; and heating said metal or metal compound particles to join said metal or metal compound particles together in an oxidizing gas atmosphere to produce a thin film of metal oxide.

2. A method according to claim 1, wherein said metal is selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

3. A method of producing a thin film of a metal compound, comprising preparing an ultrafine particle dispersion liquid containing ultrafine particles at least partly made of metal, said ultrafine particles being dispersed into a given organic solvent;

applying said ultrafine particle dispersion liquid to a surface of a substrate;

drying said ultrafine particle dispersion liquid to leave metal or metal compound particles on said substrate; and heating said metal compound particles to join said metal compound particles together in a hydrogen sulfide atmosphere to produce a thin film of metal sulfide.

4. A metal according to claim 3, wherein said metal is selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

5. A method of producing a thin film of a metal compound, comprising preparing an ultrafine particle dispersion liquid containing ultrafine particles at least partly made of metal, said ultrafine particles at least partly made of metal, said ultrafine particles being dispersed into a given organic solvent;

applying said ultrafine particles dispersion liquid to a surface of a substrate;

drying said ultrafine particle dispersion liquid to leave metal or metal compound particles on said substrate; and heating said metal or metal compound particles to join said metal or metal compound particles together in a nitriding gas atmosphere to produce a thin film of metal nitride.

6. A method according to claim 5, wherein said metal is selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

7. A method of producing a thin film of a metal compound, comprising preparing an ultrafine particle dispersion liquid containing ultrafine particles at least partly made of metal, said ultrafine particles being dispersed into a given organic solvent;

applying said ultrafine particle dispersion liquid to a surface of a substrate;

heating said ultrafine particle dispersion liquid to leave metal or metal compound particles on said substrate and join said metal or metal compound particles together; and annealing said joined metal or metal compound particles, wherein at least one of said heating and said annealing is carried out in an oxidizing gas atmosphere to a produce a thin film of metal oxide.

8. A method according to claim 7, wherein said metal is selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

9. A method of producing a thin film of a metal compound, comprising preparing an ultrafine particle dispersion liquid containing ultrafine particles at least partly made of metal, said ultrafine particles being dispersed into a given organic solvent;

applying said ultrafine particle dispersion liquid to a surface of a substrate;

heating said ultrafine particle dispersion liquid to leave metal or metal compound particles on said substrate and join said metal compound particles together; and annealing said joined metal or metal compound particles, wherein at least one of said heating and said annealing is carried out in a hydrogen sulfide atmosphere to produce a thin film of metal sulfide.

10. A method according to claim 9, wherein, said metal is selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

11. A method of producing a thin film of a metal compound, comprising preparing an ultrafine particles dispersion liquid containing ultrafine particles at least partly made of metal, said ultrafine particles being dispersed into a given organic solvent;

applying said ultrafine particle dispersion liquid to a surface of a substrate;

heating said ultrafine particle dispersion liquid to leave metal or metal compound particles on said substrate and join said metal or metal compound particles together; and annealing said joined metal or metal compound particles, wherein at least one of said heating and said annealing is carried out in a nitriding gas atmosphere to produce a thin film of nitride.

12. A method according to claim 11, wherein said metal is selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

13. A method of producing a thin film of metal compound, comprising preparing an ultrafine particle dispersion liquid containing ultrafine particles at least partly made of metal, aid ultrafine particles being dispersed into a given organic solvent;

applying said ultrafine particles dispersion liquid to a surface of a substrate;

drying said ultrafine particle dispersion liquid to leave metal or metal compound particles on said substrate;

heating said metal or metal compound particles to join said metal or metal compound particles together; and annealing said joined metal or metal compound particles, wherein at least one of said heating and said annealing is carried out in an oxidizing gas atmosphere to produce a thin film of metal oxide.

14. A method according to claim 13, wherein said metal is selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

15. A method of producing a thin film of a metal compound, comprising preparing an ultrafine particle dispersion liquid containing ultrafine particles at least partly made of metal, said ultrafine particles being dispersed into a given organic solvent;

applying said ultrafine particle dispersion liquid to a surface of a substrate;

drying said ultrafine particle dispersion liquid to leave metal or metal compound particles on said substrate;

heating said metal compound particles to join said metal or metal compound particles together; and annealing said joined metal or metal compound particles, wherein at least one of said heating and said annealing is carried out in a hydrogen sulfide atmosphere to produce a thin film of metal sulfide.

16. A method according to claim 15, wherein said metal is selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

17. A method of producing a thin film of a metal compound, comprising preparing an ultrafine particle dispersion liquid containing ultrafine particles at least partly made of metal said ultrafine particles being dispersed into a given organic solvent;

applying said ultrafine particle dispersion liquid to a surface to a substrate;

drying said ultrafine particle dispersion liquid to leave metal or metal compound particles on said surface;

heating said metal or metal compound particles to join said metal or metal compound particles together; and annealing said joined metal or metal compound particles, wherein at least one of said heating and said annealing is carried out in a nitriding gas atmosphere to produce a thin film of metal nitride.

18. A method according to claim 17, wherein said metal is selected from the group consisting of Si, Ta, Ca, Sr, Ba, Ti, Bi, Pb, Nb, Y, Mn, Al, Hf, Zr, Ce, Ir, Ru, Zn, Mg, La, Ga, Tm, Cu, Tb, Eu, Sm, and W.

* * * * *

UNITED STATES PATENT AND TRADEMARK OFFICE

CERTIFICATE OF CORRECTION

PATENT NO. : 6,517,642 B2
DATED : February 11, 2003
INVENTOR(S) : Kuniaki Horie et al.

It is certified that error appears in the above-identified patent and that said Letters Patent is hereby corrected as shown below:

Column 11,
Lines 30 and 31, delete "said ultrafine particles at least partly made of metal,"

Signed and Sealed this

Fifteenth Day of July, 2003

JAMES E. ROGAN
*Director of the United States Patent and Trademark Office*